United States Patent [19]

Brida

[11] Patent Number: 4,964,092

[45] Date of Patent: Oct. 16, 1990

[54] WRISTWATCH

[75] Inventor: Pius Brida, Schaffhausen, Switzerland

[73] Assignee: IWC International Watch Co. AG, Schaffhausen, Switzerland

[21] Appl. No.: 412,882

[22] Filed: Sep. 26, 1989

[30] Foreign Application Priority Data

Sep. 26, 1988 [DE] Fed. Rep. of Germany ..... 3832614

[51] Int. Cl.[5] ..... G04B 37/00

[52] U.S. Cl. ..... 368/282; 224/170

[58] Field of Search ..... 368/281, 282; 224/167–185

[56] References Cited

U.S. PATENT DOCUMENTS

| | | | |
|---|---|---|---|
| 3,403,505 | 10/1968 | Gisiger-Lusa | 368/282 |
| 4,742,503 | 5/1988 | Braun et al. | 368/282 |

FOREIGN PATENT DOCUMENTS

| | | | |
|---|---|---|---|
| 3309409 | 9/1984 | Fed. Rep. of Germany . | |
| 1507788 | 12/1967 | France | 368/282 |
| 319691 | 4/1957 | Switzerland | 368/282 |
| 320664 | 5/1957 | Switzerland | 368/282 |
| 331897 | 9/1958 | Switzerland | 368/282 |
| 343946 | 2/1960 | Switzerland . | |
| 343947 | 2/1960 | Switzerland . | |

*Primary Examiner*—Vit W. Miska

*Attorney, Agent, or Firm*—Martin A. Farber

[57] ABSTRACT

A wristwatch having a watchband (2) consists of a single piece, the free ends of which can be connected together by means of a buckle (5) and which can be attached to the bottom region of a watchcase (1) is detachable manner. A sleeve (4) which is open at both ends and extends approximately parallel to the dial face (3) of the wristwatch and through which the watchband (2) can be passed is developed in the bottom of the watchcase (1). A holding region (8) is provided approximately in the middle of the length of the watchband (2), within which holding region the watchcase (1) can be attached to the watchband (2) by elastic clamping of the watchband (2) in the sleeve (4).

5 Claims, 2 Drawing Sheets

WRISTWATCH

FIELD AND BACKGROUND OF THE INVENTION

The present invention relates to a wristwatch having a watchband consisting of a single part, the free ends of which can be connected together by means of a buckle and which can be connected to the bottom region of the watchcase in detachable manner.

It is known in such a wristwatch to develop the case in two parts in such a manner that there is a separation between a part of the case bearing the crystal and a bottom part. The middle of the single part watchband is placed between the upper part of the case and the bottom part and the two parts of the case are attached to each other, clamping the watchband between them. The attachment is effected by means of pins which extend from the bottom part in the direction towards the other part of the case and which can be inserted with a force-fit into corresponding holes in the upper part of the case.

In order to change the watchband it is then always necessary to take the watchcase apart, which a special pulloff device is required. In this form of connection, damage, such as scratching of the case is unavoidable.

SUMMARY OF THE INVENTION

It is an object of the invention to create a watchband of the type indicated above which makes a simple attachment and detachment of the watchband possible while avoiding any damage to the watchcase.

According to the invention, a sleeve (4) which is open at both ends and extends approximately parallel to the dial face (3) of the wristwatch is developed in the bottom of the watchcase (1), through which sleeve the watchband (2) can be passed. There is a holding region (8) provided approximately in the center of the length of the watchband (2), within which holding region the watchcase (1) is fastened to the watchband (2) by a resilient clamping of the watchband (2) in the sleeve (4).

This development makes it possible easily and rapidly to attach and detach the watchband without any special device or tool being necessary. Damage to the case is completely avoided. It is in this way also made possible to attach and detach one and the same watchband frequently without the occurrence of any wear of the parts holding the watchband on the case.

In one simple embodiment, the watchband (2) can have an elastic area of greater thickness than the height of the sleeve (4) in the holding region (8).

In order to permit rapid attachment in the correct position of installation, the holding region (8) of the watchband can be limited on the buckle side by a rigid stop (9) located on the watchband (2), which stop extends transverse to the longitudinal direction of the watchband (2) and protrudes from the plane of the watchband (2). In order to make the structural parts which hold the watchband on the case substantially invisible, the watchband (2) can be a double-layer leather, textile or plastic band between which two layers, and in the holding region, an elastic cushion is disposed.

These advantages can also be obtained in the manner that a wire which extends transverse to the longitudinal direction of the watchband (2) is arranged between the two layers at the end of the holding region (8) on the buckle side, this wire preferably being a plastic wire.

BRIEF DESCRIPTION OF THE DRAWING

With the above and other objects and advantages in view, the present invention will become more clearly understood in connection with the detailed description of preferred embodiments, when considered with the accompanying drawing, of which.

DETAILED DESCRIPTION OF THE PREFERRED EMBODIMENT

Figure 1:
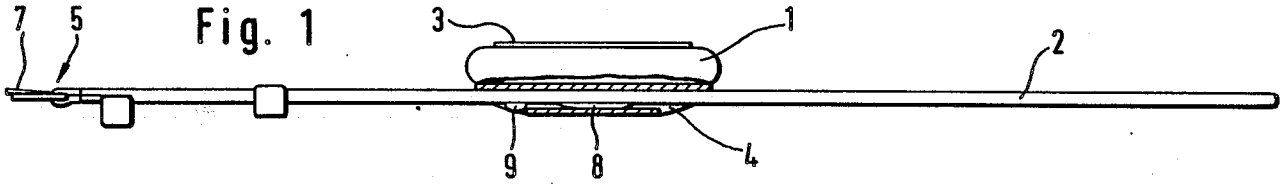
FIG. 1 is a view of a wristwatch, with the bottom of the case shown in section.
Figure 2:
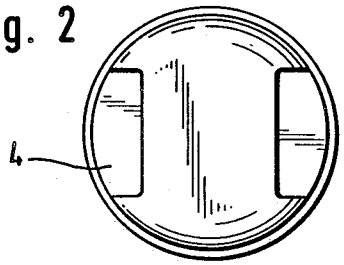
FIG. 2 is a bottom view of the watchcase of the wristwatch of FIG. 1.
Figure 3:
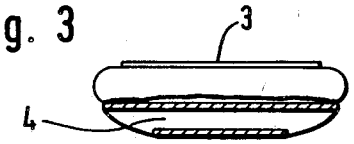
FIG. 3 is a view of the watchcase of FIG. 2, with the bottom of the case shown in section.
Figure 4:
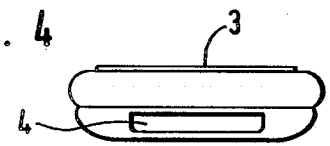
FIG. 4 is a side view of the watchcase of FIG. 2.
Figure 5:
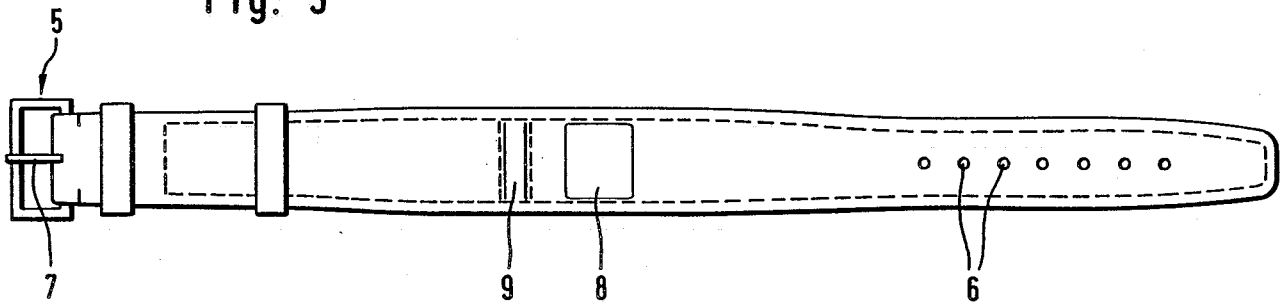
FIG. 5 is a top view of a watchband of the wristwatch of FIG. 1.
Figure 6:
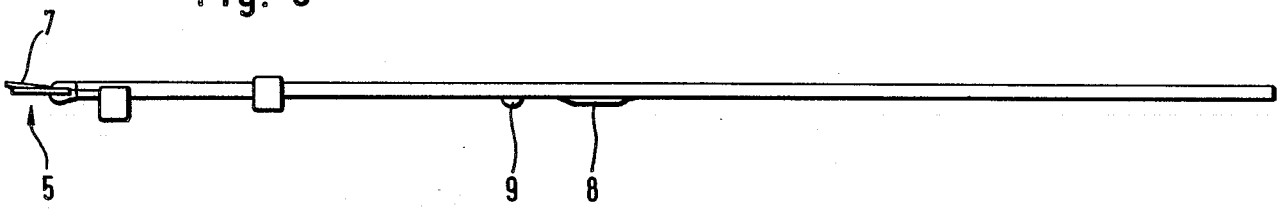
FIG. 6 is a side view of the wristwatch of FIG. 5.

The wristwatch shown in the figures consist of a watchcase 1 and a watchband 2.

A sleeve 4 which extends approximately parallel to the dial face 3 of the wristwatch in the direction from the 6 o'clock position to the 12 o'clock position is developed in the bottom of the watchcase 1. The cross section of the sleeve 4 corresponds approximately to the cross section of the watchband 2 in its middle region.

The watchband is made of a single part and has a buckle 5 on one of its free ends. In the region of the other free end of the watchband 2 there is provided a row of holes 6 into which the tongue 7 of the buckle 5 can be introduced.

The watchband 2 is developed as a double-layer leather watchband. In the middle region of the watchband 2, a holding region 8 is formed in which an elastic cushion is arranged between the two layers of the watchband 2. The thickness of the watchband 2 in the holding region is thus larger than the height of the sleeve 4.

On the buckle side, a plastic wire is arranged transverse to the longitudinal direction of the band alongside the holding region 8, between the two layers of the watchband 2. It creates a stop 9 which protrudes from the lower surface of the watchband 2 so that the watchband 2 has a greater thickness there than the height of the sleeve 4.

For the attachment of the watchband 2 to the watchcase 1, the free end of the watchband 2 opposite the buckle 5 is introduced into the sleeve 4 and passed through it until the stop 9 comes to rest against the mouth of the sleeve 4 and limits further introduction.

As soon as the holding region 8 enters the sleeve 4 upon the introduction of the watchband 2, the elastic cushion which forms a protruding arching in the direction of introduction is elastically compressed and holds the watchband 2 under elastic stress in its final position of installation in the sleeve 4.

For removal, the watchband 2 need only be pulled out of the sleeve 4 in the opposite direction.

I claim:

1. A wristwatch including a watchcase and having a watchband consisting of a single part, the watchband having free ends and a buckle, and wherein the free ends can be connected together by means of the buckle, the buckle being connectable to a bottom region of the watchcase in detachable manner; the wristwatch further comprising a sleeve which is open at both ends and extends approximately parallel to the dialface of the wristwatch, the sleeve being formed in the bottom of the watchcase and wherein the watchband can be passed through the sleeve, the watchband including a holding region provided approximately in the center of the length of the watchband; and within said holding region, the watchcase is fastenable to the watchband by resillient clamping of the watchband in said sleeve;

a rigid stop on the watchband; and wherein the holding region of the watchband is limited on the buckle side by said rigid stop, the stop extending transverse to the longitudinal direction of the watchband and projecting from a surface of the watchband.

2. A wristwatch according to claim 1, wherein the watchband has an elastic area of greater thickness in the holding region than a height of the sleeve.

3. A wristwatch according to claim 1, wherein the watchband comprises a doublelayer leather, textile or plastic band; and an elastic cushion is disposed between the two layers in a holding region of the watchband.

4. A wristwatch according to claim 3, further comprising a wire which extends transverse to the longitudinal direction of the watchband, the wire being arranged between the two layers at the end of the holding region on a buckle side of the wristband.

5. A wristwatch according to claim 4, wherein said wire is a plastic wire.

* * * * *